United States Patent [19]

Worthington

[11] 4,227,849

[45] Oct. 14, 1980

[54] REFUSE COLLECTION DEVICE

[75] Inventor: Wayne H. Worthington, 720 Prospect Blvd., Waterloo, Iowa 50701

[73] Assignee: Wayne H. Worthington, Waterloo, Iowa

[21] Appl. No.: 908,811

[22] Filed: May 24, 1978

Related U.S. Application Data

[63] Continuation-in-part of Ser. No. 873,048, Jan. 27, 1978, abandoned.

[51] Int. Cl.[3] ..... B65F 3/02

[52] U.S. Cl. ..... 414/408; 414/420; 414/501; 414/526; 414/547; 414/555

[58] Field of Search ..... 214/302, 83.32, 78, 214/79, 80; 414/403, 404, 406, 408, 419, 420, 421, 705, 552, 555, 546; 212/8 B

[56] References Cited

U.S. PATENT DOCUMENTS

| | | | |
|---|---|---|---|
| 866,393 | 9/1907 | Shaw | 212/8 B |
| 2,307,692 | 1/1943 | Linde | 214/83.32 |
| 2,488,966 | 11/1949 | Dear | 214/83.32 X |
| 2,933,210 | 4/1960 | Dye | 214/80 |
| 3,202,305 | 8/1965 | Dempster et al. | 214/302 |
| 3,458,071 | 7/1969 | Smith | 214/302 |
| 3,516,562 | 6/1970 | Knight | 214/302 |
| 3,603,464 | 9/1971 | Teodorescu | 212/8 B X |
| 3,604,577 | 9/1971 | Heilmeier | 214/302 X |
| 3,685,673 | 8/1972 | Schweis | 212/8 B X |
| 3,790,011 | 2/1974 | Owen, Jr. | 214/302 |
| 3,910,434 | 10/1975 | Ebeling et al. | 214/302 |
| 3,937,337 | 2/1976 | Irving | 214/80 |

*Primary Examiner*—Robert G. Sheridan

*Attorney, Agent, or Firm*—Knobbe, Martens, Olson, Hubbard & Bear

[57] ABSTRACT

A refuse collection device includes a pair of side-mounted lift arms with a carriage for engaging a refuse container. The carriage is laterally extendable to reach out and engage the container. The lift arms swing upward to dump the refuse from the container into a hopper. An auger in the hopper bottom precompacts the refuse and displaces it into a refuse body behind the hopper. The operation of the lift device is reversed to return the container to its original position.

14 Claims, 9 Drawing Figures

FIG. 2.
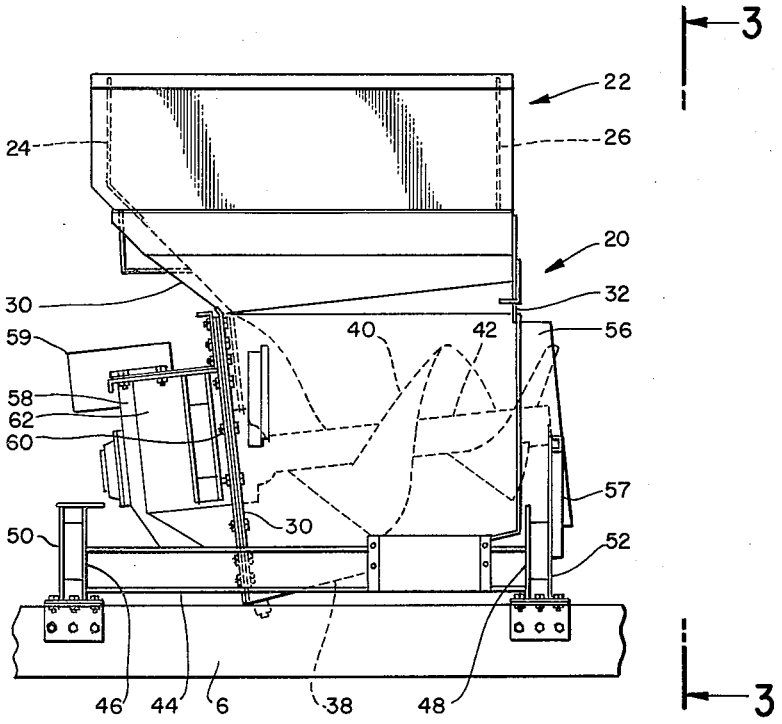
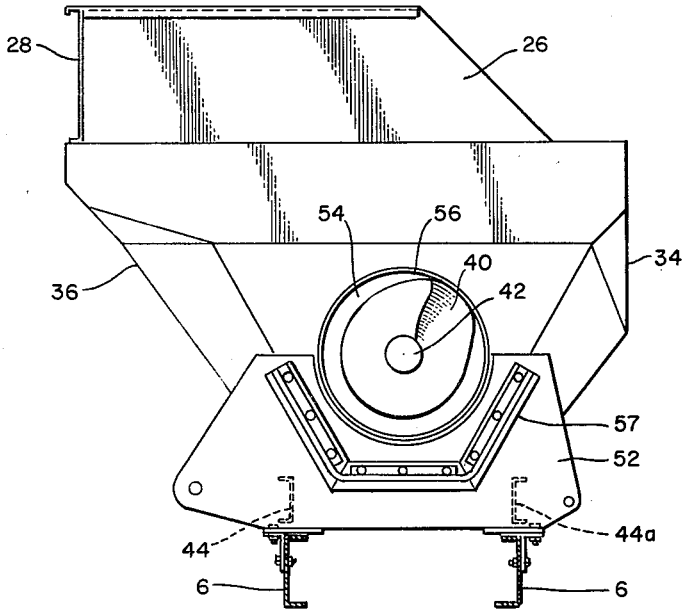
FIG. 3.

FIG. 4.
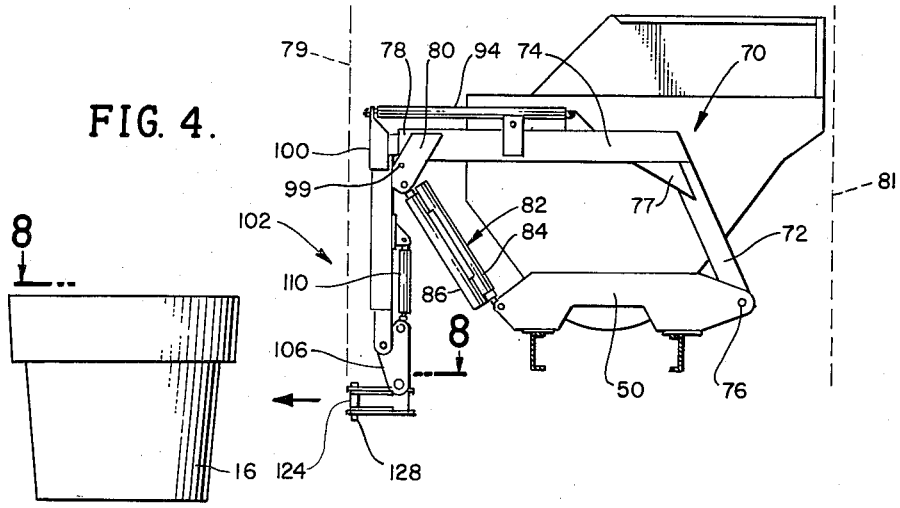
FIG. 5.
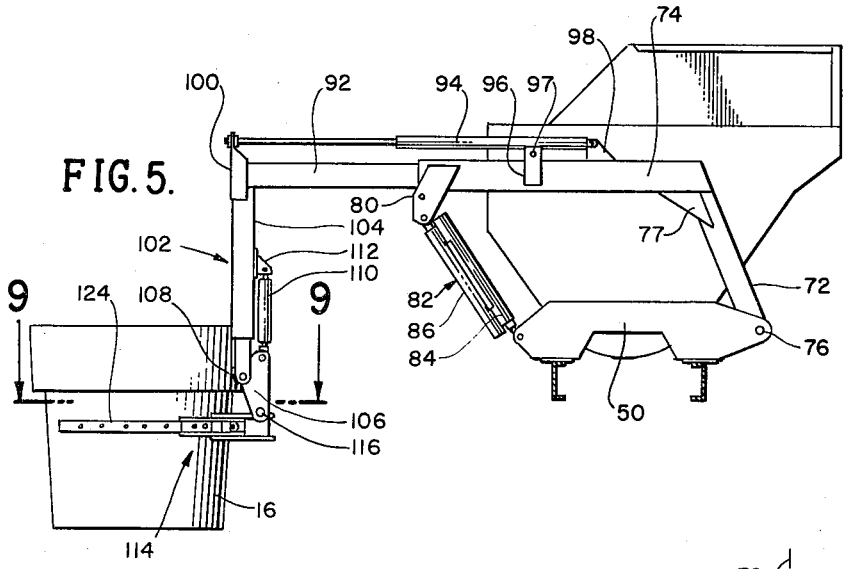
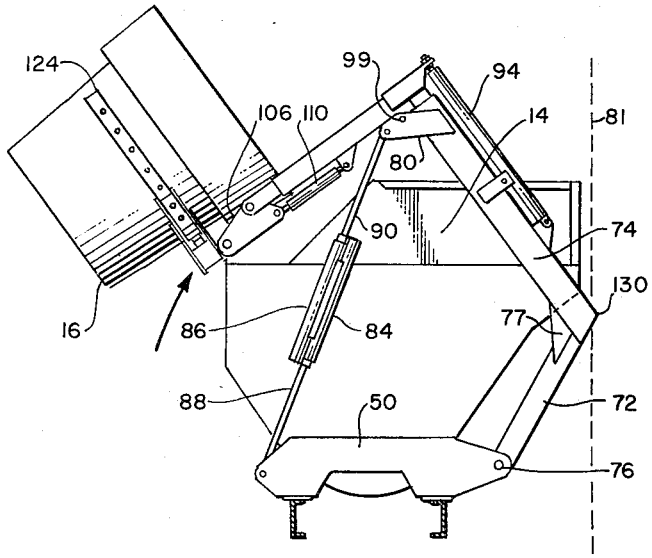
FIG.6.
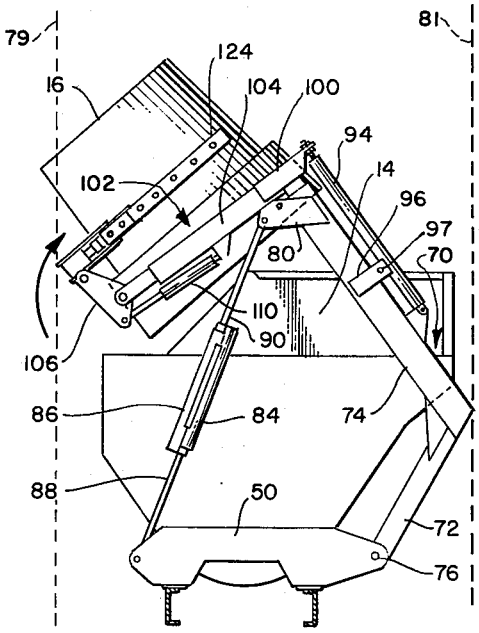
FIG. 7.

REFUSE COLLECTION DEVICE

RELATED APPLICATION

This is a continuation-in-part of my application of the same title filed Jan. 27, 1978, Ser. No. 873,048, now abandoned.

BACKGROUND OF THE INVENTION

This invention relates to refuse collection systems and specifically to side-loading refuse collection vehicles with a pivoting double arm extendable carriage to reach out and engage a container alongside the vehicle, lift the container, and dump it into a hopper having an auger in the bottom to compact the refuse into the main body, and then to return the container to its original curbside position.

Side loading refuse collection vehicles which operate without manual handling of the refuse container are known, examples being shown in U.S. Pat. Nos. 3,773,197 and 3,910,434 and in co-pending application Ser. No. 505,765. However, such prior art devices have used reciprocating plunger packers to transfer and compact the refuse. Reciprocating plungers have numerous disadvantages.

Thus, some plunger devices must be in the retracted position while the hopper is being loaded, and no load can be received while the plunger is compacting or retracting. Therefore, dumping and compacting cycles must be coordinaged and sequentially separated in those reciprocating plunger packers. Other plunger devices will take a load of refuse at any time, but the hopper must have enough capacity to accept an entire container load above the plunger, in the event a container is dumped while the plunger is near its fully extended position compacting or retracting.

Moreover, a reciprocating plunger is severely limited in the volume of refuse it can displace per square foot of plunger blade, since it operates only intermittently. Accordingly, the blade must be quite large in cross-section in order to have adequate capacity. That large cross-section reduces the compaction in the body, as the larger the cross-section of the compacting blade, for a given compacting force, the less compaction pressure.

The side-loading collection vehicles with reciprocating compactors have presented problems with design of lifting devices. The large area of the blade required that the container be lifted fairly high in order to get over the hopper and use a large part of the cross-section which might otherwise be used for loading. That has made pivoting lift arms impractical for side-loaders although some have been tried as in U.S. Pat. No. 3,790,011. Instead, the art has gone to vertical rail devices of the general type shown in U.S. Pat. No. 3,910,434. Such devices have worked satisfactorily, but are specifically designed for use with reciprocating plunger packers, are slower and are of less mechanical efficiency. Further, side-loading devices have presented problems because material deposited in the hopper or body passes the compaction blade and accumulates behind it. It must be periodically removed in order to maintain the stroke and avoid damaging the mechanism. Also, reciprocating plungers tend to compact the material along the axis where it is loaded with little lateral movement. Consequently, bodies may be unevenly loaded by the compactor.

To the extend that augers have been used at all for displacing refuse into the body, they generally have been in manually loaded rear end loaders, which may be additionally provided with ancillary container lifting and dump means. Neither has taken advantage of the high output of the auger.

SUMMARY OF THE INVENTION

Applicant has developed an improved refuse collection vehicle combining the advantages of a side-loader, which need not back away from the container, with a continuous auger compactor, and a mechanical lift device. In accordance with applicant's invention, the refuse collection vehicle has a refuse receiving body with an open-topped hopper forward of the body. An auger in the bottom of the hopper communicates with the body. A mechanical lift device with arms positioned along each end of the hopper, is adapted to engage a containr alongside the vehicle, lift the container, dump it into the hopper and return it to its original position on the ground.

An auger has inherent productivity advantages because of its continuous operation, its ability to produce higher density and the fact that at least some portion of the volume swept by the auger is continuously being refilled by material flowing from the superimposed hopper.

Auger packers typically have problems handling long items, such as boards if they are placed lengthwise of the auger axis. Applicant discovered that in a side-loader, the lifting device places long objects across the longitudinal axis of the truck and intersecting the axis of the auger, at substantially right angles because the long objects normally are placed in the refuse container vertically by the user and the lift device empties them toward the auger axis. Thus, applicant has discovered that previous fears in the art regarding the handling of long items with a mechanical lift device and auger combination, have no basis when the lift device loads over the side and the auger has its axis lengthwise of the truck.

Material deposited on an auger compactor is in continuous motion. Thus, the container may be dumped into the hopper near the edge close to the container and immediately conveyed by the turning auger across the hopper to the other side where it is worked into the body. Further, material spills into the space between the auger flanges—a space not available in a reciprocating plunger—and is conveyed away from the portion of the hopper into which it is spilled. The container may then be moved a shorter distance by the leader, dumped at a lower height to avoid overhead obstacles such as electrical wires, and emptied quickly. No material accumulates behind the compactor or in areas from which it must be removed to protect equipment.

An auger arranged in a hopper which converges axially along the auger, compacts refuse in all three dimensions, whereas a reciprocating plunger only compacts lengthwise. In addition, an auger does much more shredding of the refuse than does a reciprocating plunger. Shredding allows the material to be packed to a higher density than otherwise, and tears plastic bags apart to make their contents bio-degradable. Further, augers have a very high mechanical advantage for compacting. While those differences exist in prior art auger compactors, applicant has taken unique advantage of those features in his combination auger and mechanical lift device.

A limiting factor in the design of any refuse collection truck is the need to keep the parts of the truck within the legally allowed "envelope." The envelope is the term used to define the width and height limits imposed by law on vehicles which travel on public roads. Generally the legal envelope is 13 feet 6 inches high and 8 feet wide. Nothing on the truck should extend out of that envelope while the truck is moving on the highway.

The three dimensional compaction, shredding, and fast and continuous displacement of refuse with the auger permits a major reduction in cross-section of the auger compactor as compared to a reciprocating compactor of like capacity. Therefore, the reduced cross-section means that the packer occupies less of the space within the legal envelope, leaving more space for a mechanical lift device.

The auger, by virtue of its smaller cross-section also provides a higher compacting pressure. That higher pressure transmits hydraulically into the large refuse body providing excellent compaction. Mixing the refuse as it is sheared, compressed and shredded by the revolving auger, improves compactability by jostling material to improve its "fit" together, distributing moisture throughout the load.

In the preferred embodiment, the side-loader is a pair of arms pivoted to the vehicle well below the hopper opening and on the opposite side of the hopper from the container to be dumped. One arm is located forward of the hopper and the other is rearward. The arms extend up and over the auger and have at their distal ends a carriage which is mounted to reciprocate laterally toward and away from the hopper. Clamps or other engaging devices on the carriage are operable to engage or disengage the container.

This pivoting arm arrangement in combination with the continuous auger provides a very fast and productive device. The pivoting movement need not lift the refuse container as high as a comparable vertical track device. The container moves along a shorter path from its location on the ground to a dumping position with the lip inside the edge of the hopper.

Moreover, in the vertical track devices, as the container goes over any curved portion of the tract, the center of gravity of the load is accelerated with respect to movement of the conveyor system. The conveyor system must be designed to handle that peak power requirement, and therefore operates at less than full capacity during the rest of the cycle. In a pivoting arm arrangement, that peak is eliminated and a lower capacity power system can be used.

This faster pivoting movement finds particular advantage with the auger compactor which is able to handle the greater capacity of the pivoted arm because of the proficiency of the continuous displacement and the three dimensional compaction. Moreover, the low profile and open configuration of the auger permit a lower hopper top so that the lift device need not lift the container so high nor pivot through as great an arc as with the higher hopper associated with a reciprocating compactor of like capacity. The shorter arc, through which the arms swing, increases the minimum lever arm available for lifting, and correspondingly reduces the lifting force.

The arms and carriage of the preferred embodiment extend in a generally inverted U-shape from a low pivot, over the auger ends and back down to the refuse container. The low pivot, being little higher than the container, assures that the container movement outward away from the vehicle is minimized at the beginning of its lift, and such movement can cause collision with nearby obstacles. The U-shaped lift arms are practical with the auger because the aguer occupies only a small cross-section for its high displacement rate. Thus, the U can be of low profile and still clear the auger. That low profile, as well as the low angle of lift required for the container to clear the hopper, permit arms which do not extend laterally outside the vehicle envelope any significant distance even when the device is elevated.

The dumping action of the lift device of this invention pivots the container about a very small radius, whereas the prior art rail devices swing the container through a larger arc across the truck top. The difference further reduces the time required to dump a container.

These and other advantages will be apparent from the following description of a preferred embodiment.

BRIEF DESCRIPTION OF THE DRAWINGS

FIG. 2 is a left side elevation view of the hopper and auger with the remainder of the vehicle, and the lifting device, removed;

FIG. 3 is a front elevation view of the hopper and auger taken along lines 3—3 of FIG. 2;

FIG. 4 is a front elevation view of the hopper and lifting device with the remainder of the vehicle removed, showing the lift device about to engage a refuse container;

FIG. 5 is a view like FIG. 4 showing the carriage extended for engaging the container;

FIG. 6 is a view like FIG. 4, showing the arms pivoted to the raised position, lifting the container over the hopper;

FIG. 7 is a view like FIG. 4, showing the carriage clamps rotated to dump the container;

Referring to FIG. 1, the refuse collection vehicle includes a conventional cab 2 with the usual controls for the operator 4 to drive the vehicle. The frame 6 of the vehicle, of course, is supported from the ground 8 on wheels 10 in a conventional manner and includes a conventional refuse collection body 12 for accumulating refuse. A hopper 14 between the body 12 and cab 2 receives refuse from a refuse container 16 which is elevated from its initial position on the ground alondside the vehicle, and is dumped by lifting mechanism 18. The refuse in the hopper is compacted and transferred to the refuse body by an auger in the hopper bottom as shown in FIG. 2. The body 12 includes a power-actuated tail-gate assembly 11, which is raised to allow refuse to shift from the body as the body is tipped.

Referring to FIGS. 1–3, the hopper 14 has a tapered lower portion 20 and an auger extension 22, which, of course, could be a single piece. The upper extension 22 has a forward end wall 24, rear end wall 26, and left side wall 28, but is open at the top, right side, and bottom for receiving refuse and directing it to the lower portion 20. The lower portion includes a forward end wall 30, rear end wall 32, right side wall 34 and left side wall 36 and bottom 38. An auger 40 is mounted in the hopper just above the bottom, this axis or shaft 42 of the auger in the vertical plane and through the longitudinal axis of the truck, inclines upwardly from front to rear.

Figure 1:
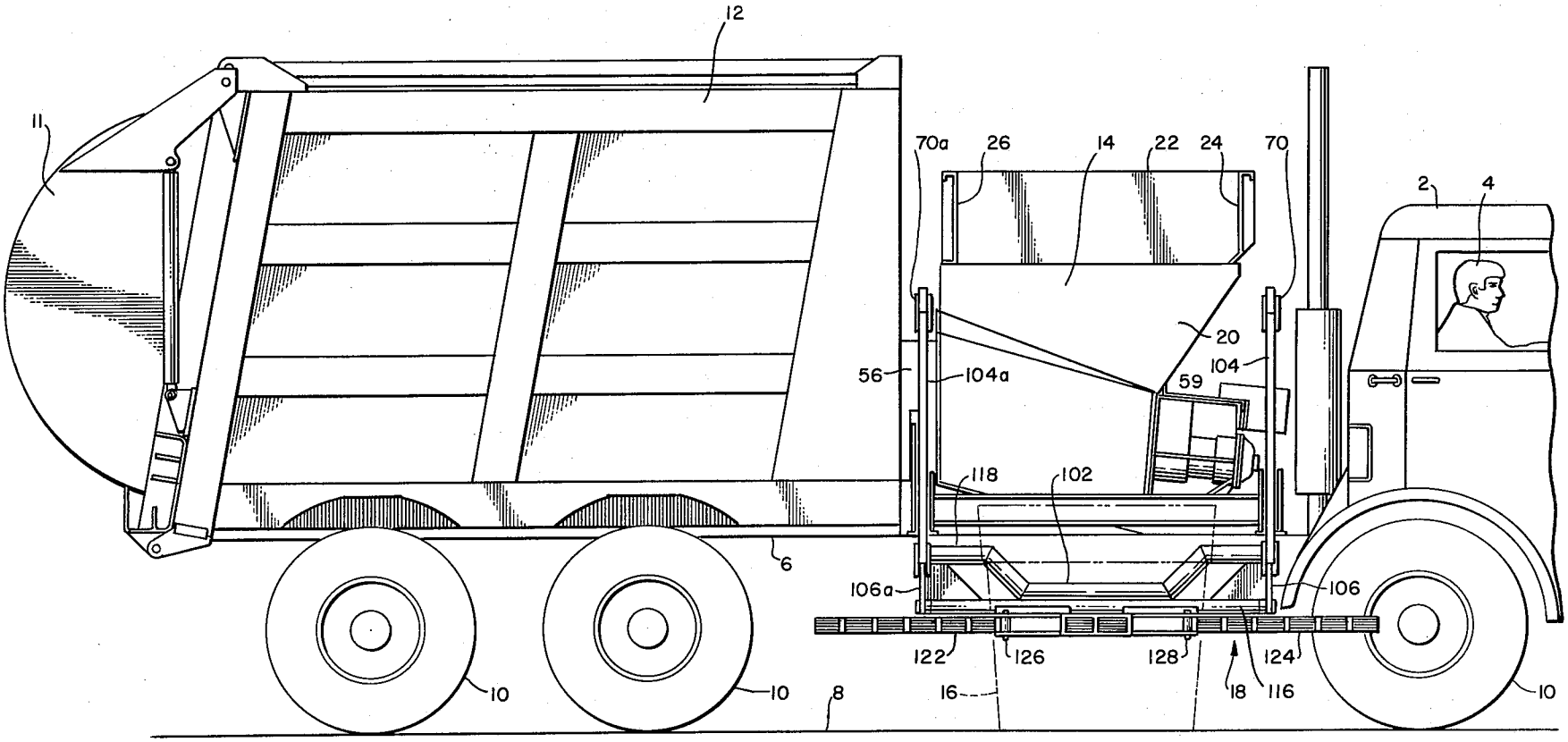
FIG. 1 is a right side elevation view of a refuse collection vehicle in accordance with this invention.

The lower walls of the hopper portion are of a complex shape as shown in the drawings, but are generally tapered inwardly from top to bottom to direct the refuse of the auger, and converge along the auger axis in a conical shape. The bottom 38 generally follows the auger, but defines the bottom half of a truncated cone which converges as it progresses rearwardly along the axis of the auger.

The hopper is mounted on members 44, 44*a* and 52 which are supported on the truck frame 6. The members /46 and 48 each have a plate 50, 52 on their respective forward and rear sides for mounting the lift device as will be described later.

The rear wall 32 has an opening 54 through which the rear end of the auger passes. The opening 54 aligns with a corresponding opening in the body 12 to pass refuse from the hopper to the body. The rear end of the auger actually extends slightly into the body 12.

A shroud 56 surrounds the rear portion of the auger and provides a conduit for refuse between the opening 54 in the hopper and the corresponding opening in the body 12. A seal 57 below the shroud 56 seals against the body 12 to further prevent loss of refuse.

A motor 59 and gear box 58 at the forward end of the auger drive the auger in a conventional manner. The auger 40 and its motor 59 and gear box 58 are mounted on the hopper, e.g. by bolts 60, and the auger extends through an opening in the forward wall 30 of the hopper which is sealed by the flanges 62 on the gear box.

The auger is of variable pitch, decreasing in pitch from front to rear, and also decreases in diameter from front to rear. That causes the auger to pre-compact the refuse within its swept volume in the hopper as it is transferred axially to the body. Moreover, the conical shape of the hopper bottom portion in which the auger is positioned, causes the refuse to compact vertically and laterally as it is displaced rearward. Within the body, it is further compacted as the body fills, by the force of the auger pushing additional refuse into the body.

Referring now to FIG. 4, the lift assembly includes an arm 70 having a lower arm member 72 and an upper arm member 74 rigidly interconnected at 77 in a general L-shape. The lower arm member 72 is mounted between plates 46 and 50 for pivotal movement about an axis 76 parallel to the longitudinal axis of the truck (right and left being reversed in FIG. 4 which look toward the rear of the truck). In the lowered position as the pivot 76 which is near the hopper bottom and on the left side of the vehicle, but inclined toward the vehicle centerline. The upper arm member 74 extends horizontally across the truck from its connection 77 so that its distal end 78 is to the right of the hopper and is far enough to the right to clear any frame members or vehicle accessories beneath it.

The sides of the "envelope", i.e. legal width and height, within which all parts of the truck must be when the truck is moving are indicated at 79, 81.

A ram assembly 82 is connected between the plate 50 and a gusset 80 mounted near the distal end of the arm. That ram assembly is operable to pivot the arm as shown in FIG. 6, and preferably consists of two parallel ram cylinders 84, 86 side-by-side having their respective piston rods 88, 90 extending in opposite directions to double the available stroke for the given length of ram cylinder.

Referring to FIG. 5, the upper arm member 74 is a hollow tube, preferably of rectangular section. Telescoped into the upper arm member 74 is a carriage extension arm 92. A cylinder assembly 94 is attached to the upper arm member 74 by bracket 98 and to the outer end of the carriage extension arm 92 by a bracket 100. The cylinder assembly 94 is operable to extend and retract the carriage extension arm 92 as shown in FIG. 5. A bracket 96 mounted on the arm member 74 has a roller (not shown) on supporting pin 97 which extends down through an opening in the top of arm member 74 and bears on the top of extension 92 to provide a bearing for movement of the extension 92. A forward roller (not shown) on a supporting pin 99 on the gusset 80 similarly provides a bearing for the underside of the extension 92 so that the extension is supported by the two bearings.

A carriage assembly 102 is mounted on the outer end of the extension arm 92. Upright carriage member 104 is attached at its upper end to the extension arm and depends generally vertically down therefrom. A pivot plate 106 is pivotally mounted on the bottom of the upright carriage member on pin 108.

A container dumping cylinder assembly 110 is connected to the upright member 104 by a bracket 112 and to the pivot plate 106. A container grasping clamp assembly 114 is rigidly mounted to a connecting tube 116 and extends outwardly therefrom. The connecting tube 116 is rigidly connected to the pivot plate 106.

Referring again to FIG. 1, it can be seen that lift assembly 18 includes two identical arm assemblies 70, 70*a*. One 70 is mounted forward of the hopper and the other 70*a* is mounted rearward. Each arm assembly has a respective carriage extension arm 92, upright carriage member 104, 104*a* and pivot plate 106, 106*a*. A tubular frame member 118 interconnects the upright carriage members 104, 104*a* to rigidify the lifting device, and has an offset center portion 102 to accommodate the refuse container as it is dumped.

Figure 8:
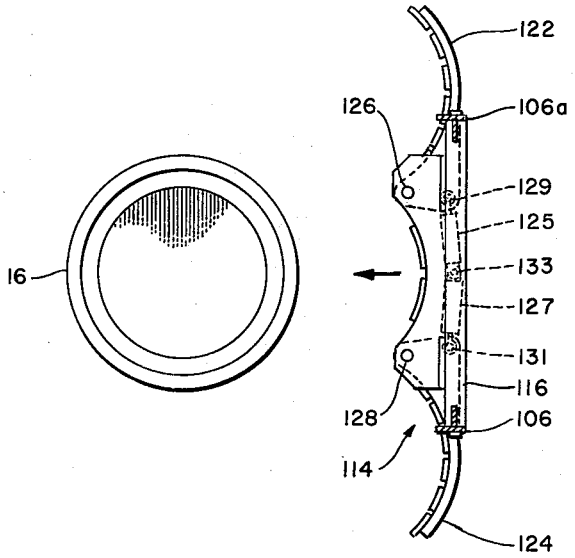
FIG. 8 is a top view of the container and carriage clamp taken along lines 8—8 of FIG. 4.
Figure 9:
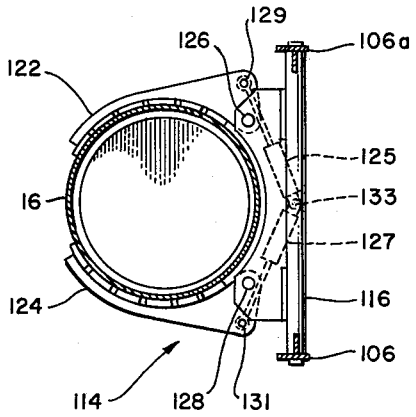
FIG. 9 is a top view of the container and carriage clamp taken along lines 9—9 of FIG. 5.

Referring to FIGS. 8 and 9, the grasping clamp assembly 114 is fixed to rotate with the connection 116 and includes a pair of clamping fingers 122, 124 mounted to pivot about vertical pins 126, 128 to open and close the clamp. Cylinder assemblies 125, 127 are connected at 129, 131 and 133 on the clamp assembly to open and close the clamp.

The various cylinder and ram assemblies are controlled by the operator 4 from the driver's position by controls in the cab which may be arranged in a convenient array.

In operation the vehicle is driven toward a position alongside a container 16 in the position shown in FIG. 7 (except that no container 16 is grasped in the clamp assembly) with the arm 70 up, the carriage 102 retracted, and the clamp assembly up. That position locates the entire lifting device within the width of the envelope 79, 81 so that no part of the lift device or its operating mechanism extends out to be a hazard.

The vehicle is stopped with the lift device centered opposite the container 16 and close enough to the container to be within reach of the lift device when laterally extended and the lift mechanism is lowered to the position of FIG. 4 with the arm 70 lowered, the clamp assembly 102 lowered, and the clamp fingers 122, 124 open. If there are no obstructions, this lowering may be carried out as the vehicle approaches the container rather than waiting for a full stop.

The carriage 102 then is extended laterally, by extension of cylinder assemblies 94, 94*a*, to the position of FIG. 5. The carriage is now adjacent the container 16 and the clamp cylinder assemblies 125, 127 are then operated to close the clamp fingers 122, 124 around the container and squeeze it as shown in FIG. 9. The operator is in sight of the container 16 and the clamp, and visually determines how far to extend the carriage. If the container is not precisely centered on the clamp, the closing of the clamp will center it within.

With the container grasped in the clamps, the arm 70 is elevated by extension of the ram assembly 82 to lift the container off the ground. The carriage 102 is simultaneously retracted by retraction of cylinder assembly 94 to bring the container toward the truck as it lifts. Referring now to FIG. 6, the arm 70 continues to elevate by extension of ram assembly 82 to its maximum elevation while the carriage continues to retract toward the truck until fully retracted. The container is now over the open top of the hopper. Next the cylinder 110 is extended to rotate the pivot plate 106 and dump the container as shown in FIG. 7. In order to increase the speed, the rotation to dump can begin before the lift arms are fully elevated.

The operation is then reversed, with the piston assembly 110 being retracted, the lift arms being lowered by retraction of the ram assembly 82 and the carriage being extended by extension of piston assemblies 94, 94*a*, all of which may be done simultaneously. The container is thus returned to its original position, and the clamp fingers are opened to release the container. The carriage then is retracted, the arm raised, and the clamp assembly raised to the position of FIG. 7. The truck is then ready to drive on to the next container. Alternatively, the truck can be advanced to the next container stop during the lifting dumping and lowering cycle. In that event, each container will be moved down the street one station, each time the truck mans the route. That is sometimes acceptable because the containers are of standard size and usually are provided by the refuse collection or the city.

The refuse falls into the hopper 14 and down into the path of the auger. The augur pre-compacts the refuse in three dimensions and also shreds it as it moves it along the hopper bottom, because of the decreasing pitch and decreasing diameter. The auger pushes the refuse into the body with enough force to compact the refuse in the body without an additional compactor.

It can be seen that the location of the boom pivot 76 is at about the height of the large diameter portion of the container to be lifted. Therefore, as the arms elevate, the container swings out only a little further from the vehicle during its initial lift.

The lift device is generally of inverted U-shape, i.e. arm members 72, 74 and upright carriage member 104 from an inverted U. That enables the lift device to clear the shroud 56 and the motor 59. However, in the elevated position as shown in FIGS. 6 and 7, the arm extends barely beyond the hopper at the furtherest point 130 so that it will not be a hazard to passing traffic. This lack of protrusion is enhanced by the fact that lower arm member 72 is not vertical in the unrelated position of FIG. 4. The use of a small diameter auger permits the lateral inclination of the lower lift arm member as seen in FIG. 4 to be greater than with a reciprocating plunger.

I claim:

1. A side loading refuse collection vehicle comprising:

a refuse receiving body;

a hopper disposed adjacent said body and open at the top to receive refuse;

an opening near the bottom of said hopper in the wall adjacent said body for transferring refuse from said hopper to said body;

an opening in the wall of said body adjacent said hopper for receiving refuse transferred from said hopper through the opening therein;

a screw-type auger in said hopper, aligned with said openings, and operable to transfer refuse from said hopper to said body, said auger having its axis generally longitudinal of the vehicle;

a side loading lifting device having an arm mounted on said vehicle adjacent said hopper so as to be pivotable about an axis parallel to the axis of said auger and the arm located generally transverse to the axis of said auger so that elongate articles, normally loaded vertically in a refuse container when loaded will be transverse to the auger axis;

means for extending at least a portion of said arm for automatically engaging a refuse container alongside said vehicle; and means for operating said lifting device to raise the container over the hopper and auger and dump the contents of said container into said hopper.

2. A vehicle in accordance with claim 1 wherein said hopper is forward of said body.

3. A vehicle in accordance with claim 2 wherein said arm member is pivotally mounted on one side of said vehicle adjacent said hopper about an axis parallel to the longitudinal axis of said vehicle which extends from said one side of the vehicle generally transverse across the vehicle to the other side of said vehicle, whereby said container is lifted and inverted so that its contents are dumped into said hopper.

4. A vehicle in accordance with claim 3 wherein said pivot axis is located at about the height of the refuse container to be lifted.

5. A vehicle in accordance with claim 4 wherein said container engaging means is pivotally mounted to said lifting means on said other side of said vehicle, and said arm member extends upward, over said auger, and downward on the opposite side of the auger.

6. A side loading collection vehicle comprising:

a refuse receiving body;

a hopper disposed adjacent said body and open at the top to receive refuse;

a screw-type auger having its axis generally longitudinal to said vehicle and operable to transfer refuse from said hopper to said body;

a pair of lifting members, each pivotally mounted adjacent one end of said hopper about an axis parallel to said axis of said auger and extending from one side of the vehicle generally transverse across the vehicle on each end of said hopper to the other side of said vehicle;

means for engaging a refuse container pivotally mounted to said lifting members on said other side of said vehicle and extending laterally therefrom; and means for operating said lifting members to raise said container over said hopper and said auger and dump the contents of said container into said hopper.

7. A side loading refuse collection vehicle comprising:

a refuse receiving body;

a hopper disposed adjacent said body and open at the top to receive refuse;

an opening near the bottom of said hopper in the wall adjacent said body for transferring refuse from said hopper to said body;

an opening in the wall of said body adjacent said hopper for receiving refuse transferred from said hopper through the opening therein;

transfer means in said hopper, aligned with said openings, and operable to transfer refuse from said hopper to said body;

a side loading lifting device mounted on one side of said vehicle adjacent said hopper having means thereon for engaging a refuse container alongside said vehicle; and means for operating said lifting device to raise the container over the hopper and auger and dump the contents of said container into said hopper, said means for operating said lifting device comprising an arm member pivotally mounted on one side of said vehicle opposite said container engagement means adjacent said hopper about an axis parallel to the longitudinal axis of said vehicle, and extending transversely upward over said transfer means and downward on the opposite side of the transfer means to the other side of said vehicle.

8. A side loading refuse collection vehicle comprising:

a refuse receiving body;

a hopper disposed adjacent and forward of said body and open at the top to receive refuse;

an opening near the bottom of said hopper in the wall adjacent said body for transferring refuse from said hopper to said body;

an opening in the wall of said body adjacent said hopper for receiving refuse transferred from said hopper through the opening therein;

a screw-type auger in said hopper, aligned with said openings, and operable to transfer refuse from said hopper to said body, said auger having its axis generally longitudinal of the vehicle;

a side loading lifting device comprising an arm member pivotally mounted on one side of said vehicle adjacent said hopper about an axis located at about the height of the refuse container to be lifted and parallel to the longitudinal axis of said vehicle, said arm member extending transversely upward, over said auger, and downward on the opposite side of the auger to the other side of said vehicle and having means thereon for engaging a refuse container along side said vehicle, said container engaging means being pivotally mounted to said lifting means on said outer side of said vehicle; and means for operating said lifting device to raise the container over the hopper and auger and dump the contents of said container into said hopper.

9. A side loading collection vehicle comprising:

a refuse receiving body;

a hopper disposed adjacent said body and open at the top to receive refuse;

a screw-type auger having its axis generally longitudinal to said vehicle and operable to transfer refuse from said hopper to said body;

a lifting member pivotally mounted adjacent one end of said hopper about an axis parallel to said axis of said auger and extending from one side of the vehicle generally transverse across the vehicle to the other side of said vehicle;

means for engaging a refuse container pivotally mounted to said lifting member on said other side of said vehicle and extending laterally therefrom; and means for operating said lifting member to raise said container over said hopper and said auger and dump the contents of said container into said hopper.

10. A vehicle in accordance with claim 8 wherein said arm does not extend laterally beyond said vehicle on the pivot side, when said arm is in the elevated position.

11. A side loading refuse collection vehicle for automatically dumping a refuse container located alongside a roadway comprising:

a frame;

a hopper on said frame having a top opening for receiving refuse;

an arm mounted on said vehicle and pivotal about an axis generally parallel to the longitudinal axis of said vehicle and located on the opposite side of said hopper from said container to be dumped and disposed below the top opening of said hopper and at about the height of said container;

power means for pivoting said arm upward;

a carriage on the distal end of said arm and mounted for translating reciprocation toward and away from said vehicle perpendicular to said axis to engage said container;

second power means for reciprocating said carriage;

engaging means connected to said carriage arm for engaging said refuse container and mounted for pivotal movement about a second axis generally parallel to said first axis;

third power means for pivoting said engaging means about said second axis; whereby said refuse container is substantially inverted; and said arm, carriage and engaging means being arranged so that said engaged container is raised over said hopper by operation of said first and second power means and dumped by said third power means.

12. A vehicle in accordance with claim 11 wherein said arm includes a generally horizontal portion and said carriage includes means reciprocating along said portion.

13. A vehicle in accordance with claim 12 wherein said reciprocating means is a tube telescoped with said arm horizontal portion.

14. A vehicle in accordance with claim 11 wherein said hopper has an auger in the bottom thereof for transferring refuse from the hopper.

* * * * *